United States Patent [19]

Beaver et al.

[11] Patent Number: 4,871,703

[45] Date of Patent: Oct. 3, 1989

[54] PROCESS FOR PREPARATION OF AN ELECTROCATALYST

[75] Inventors: Richard N. Beaver; Lloyd E. Alexander, both of Angleton; Carl E. Byrd, Richwood, all of Tex.

[73] Assignee: The Dow Chemical Company, Midland, Mich.

[21] Appl. No.: 134,269

[22] Filed: Dec. 17, 1987

Related U.S. Application Data

[63] Continuation-in-part of Ser. No. 68,773, Jun. 26, 1987, Pat. No. 4,760,041, which is a continuation of Ser. No. 848,516, Apr. 7, 1986, abandoned, which is a continuation of Ser. No. 499,626, May 31, 1983, abandoned.

[51] Int. Cl.[4] ..... H01M 4/88; C25B 13/00

[52] U.S. Cl. ..... 502/101; 204/282; 204/290 R; 502/326; 502/337

[58] Field of Search ..... 204/282, 283, 290 R, 204/296; 427/126.1, 126.3, 126.5, 126.6, 380, 77, 78; 156/308.2; 502/101, 326, 337

[56] References Cited

U.S. PATENT DOCUMENTS

| | | | |
|---|---|---|---|
| 1,263,959 | 4/1918 | Swartley, Jr. | 428/679 |
| 2,928,783 | 3/1960 | Bacon | 204/283 |
| 2,969,315 | 1/1961 | Bacon | 204/284 |
| 3,219,730 | 11/1965 | Bliton et al. | 264/0.5 |
| 3,272,788 | 9/1966 | Dietz | 260/93.7 |
| 3,282,875 | 11/1966 | Connolly et al. | 260/29.6 |
| 3,316,159 | 4/1967 | Louzos | 204/23 |
| 3,326,725 | 6/1967 | Guth et al. | 136/120 |
| 3,403,057 | 9/1968 | Stankavich et al. | 136/120 |
| 3,427,204 | 2/1969 | Clune et al. | 136/126 |
| 3,492,720 | 2/1970 | Guthke et al. | 29/592 |
| 3,497,425 | 2/1970 | Cotton et al. | 204/37 |
| 3,616,445 | 10/1971 | Bianchi et al. | 204/290 F |
| 3,618,136 | 11/1971 | Fujita | 335/202 |
| 3,630,770 | 12/1971 | Favreau | 117/230 |
| 3,632,498 | 1/1972 | Beer | 204/290 F |
| 3,649,355 | 3/1972 | Hennig | 117/217 |
| 3,711,385 | 1/1973 | Beer | 204/59 |
| 3,713,891 | 1/1973 | Curelop et al. | 136/30 |
| 3,788,968 | 1/1974 | Müller et al. | 204/290 R |
| 3,802,878 | 4/1974 | Lindstrom | 75/208 R |
| 3,869,312 | 3/1975 | Moss et al. | 117/215 |
| 3,909,378 | 9/1975 | Walmsley | 204/98 |
| 3,945,907 | 3/1976 | Gokhale | 204/226 |
| 3,974,058 | 8/1976 | Gokhale | 204/266 |
| 3,977,958 | 8/1976 | Caldwell et al. | 204/252 |
| 3,990,957 | 11/1976 | Hoekje et al. | 204/128 |
| 3,992,278 | 11/1976 | Malkin et al. | 204/242 |
| 4,003,817 | 1/1977 | Bianchi et al. | 204/290 R |
| 4,025,405 | 5/1977 | Dotson et al. | 204/98 |
| 4,061,549 | 12/1977 | Hazelrigg, Jr. et al. | 204/98 |
| 4,065,366 | 12/1977 | Oda et al. | 204/98 |
| 4,072,585 | 2/1978 | Bianchi et al. | 204/98 |
| 4,073,873 | 2/1978 | Caldwell et al. | 423/499 |
| 4,100,049 | 7/1978 | Brannan | 204/242 |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 204/296 |
| 4,142,005 | 2/1979 | Caldwell et al. | 427/126 |
| 4,151,052 | 4/1979 | Goto et al. | 204/95 |
| 4,176,215 | 11/1979 | Molnar et al. | 521/27 |
| 4,178,218 | 12/1979 | Seko | 204/98 |
| 4,191,618 | 3/1980 | Coker et al. | 204/283 |
| 4,192,725 | 3/1980 | Dotson et al. | 204/98 |
| 4,209,635 | 6/1980 | Munekata et al. | 560/183 |
| 4,212,713 | 7/1980 | Suhara et al. | 204/98 |
| 4,238,311 | 12/1980 | Kasuya | 204/290 R |
| 4,251,333 | 2/1981 | Suhara et al. | 204/98 |
| 4,270,996 | 6/1981 | Suhara et al. | 204/98 |
| 4,272,353 | 6/1981 | Lawrance et al. | 204/283 |
| 4,279,709 | 7/1981 | McIntyre et al. | 204/98 |
| 4,293,394 | 10/1981 | Darlington et al. | 204/98 |
| 4,299,674 | 11/1981 | Korach | 204/98 |
| 4,299,675 | 11/1981 | Korach | 204/98 |
| 4,300,992 | 11/1981 | Yoshida et al. | 204/242 |
| 4,315,805 | 2/1982 | Darlington et al. | 204/98 |
| 4,319,969 | 3/1982 | Oda et al. | 204/98 |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,680 | 7/1982 | Asawa et al. | 521/27 |
| 4,345,986 | 8/1982 | Korach | 204/266 |

(List of continued on next page.)

FOREIGN PATENT DOCUMENTS

| | | |
|---|---|---|
| 1072915 | 3/1980 | Canada . |
| 0027009 | 4/1981 | European Pat. Off. . |
| 0046449 | 2/1982 | European Pat. Off. . |
| 31-006611 | 8/1956 | Japan . |
| 40-009130 | 5/1965 | Japan . |
| 1553367 | 9/1979 | United Kingdom . |

OTHER PUBLICATIONS

Vol. 1 of 3rd Edition of *Encyclopedia of Chemical Technology,* Kirk-Othmer, pp. 799-833.

W. J. Moore, *Physical Chemistry,* 3rd Edition, 1962, pp. 406-408.

Melendres, Carlos A., Spring Meeting Electrochem. Soc., May 11-16, 1975.

*Primary Examiner*—John F. Niebling
*Assistant Examiner*—Kathryn Gorgos

[57] ABSTRACT

The invention is a method for preparing electrocatalytic oxides and applying them to substrates that cannot be heated to temperatures sufficiently high to convert electrocatalytic salts into electrocatalytic oxide comprising:

(a) dissolving Ru salt(s) and Ni salt(s) in a solvent to form an electrocatalytic salt solution;

(b) evaporating the solvent from the electrocatalytic salt solution, leaving a electrocatalytic salt residue;

(c) heating the electrocatalytic salt residue in the presence of oxygen to a temperature and for a time sufficient to convert substantially all of the electrocatalytic salt into a electrocatalytic oxide; and (d) bonding the so-formed electrocatalytic oxide to a substrate that would be detrimentally affected if it were to be heated to 480°-500° C.

17 Claims, No Drawings

U.S. PATENT DOCUMENTS 4,357,218 11/1982 Seko ..... 204/98
4,358,412 11/1982 Ezzell et al. ..... 260/968
4,358,545 11/1982 Ezzell et al. ..... 521/27
4,364,815 12/1982 Darlington et al. ..... 204/283
4,386,987 6/1983 Covitch et al. ..... 156/155
4,394,229 7/1983 Korach ..... 204/98
4,416,932 11/1983 Nair ..... 428/209
4,417,969 11/1983 Ezzell et al. ..... 204/252
4,457,822 7/1984 Asano et al. ..... 204/290 R
4,462,877 7/1984 Ezzell ..... 204/98
4,469,579 9/1984 Covitch et al. ..... 204/283
4,470,889 9/1984 Ezzell et al. ..... 204/98
4,478,695 10/1984 Ezzell et al. ..... 204/98
4,498,942 2/1985 Asano et al. ..... 156/151
4,738,741 4/1988 McMichael ..... 156/235
4,752,370 6/1988 McMichael et al. ..... 204/283

PROCESS FOR PREPARATION OF AN ELECTROCATALYST

BACKGROUND OF THE INVENTION

This is a continuation-in-part application of Ser. No. 068,773 filed June 26, 1987 now U.S. Pat. No. 4,760,041 which is a continuation of application Ser. No 848,516 filed Apr. 7, 1986 (now abandoned). which is a continuation of application Ser. No. 499,626 filed May 31, 1983 (now abandoned).

This invention pertains to a method for applying an electrocatalyst, which requires that it be heated to a temperature sufficient to convert it into its oxide state, onto substrates that would otherwise be detrimentally affected by heating to temperatures sufficient to convert electrocatalytic salts to electrocatalytic oxides.

There are four general types of electrolytic cells used for the production of chlor-alkali: (1) the mercury cell, (2) the diaphragm cell, (3) the membrane cell, and (4) membrane/electrode combination cell. The operation of some of these cells is discussed in Volume 1 of the Third Edition of the *KIRK-OTHMER ENCYCLOPEDIA OF CHEMICAL TECHNOLOGY.* page 799 et. seq. Other electrolytic cells which employ electrodes for electrolysis of aqueous solutions are the so-called "chlorate cells" which do not use a divider or separator between the cathodes and anodes. In the mercury cell, the alkali metal values produced by electrolyzing an alkali metal salt form an amalgam with the mercury: the amalgam, when reacted with water, produces NaOH and frees the mercury which can be recovered and cycled back for further use as a liquid cathode.

In many chlor-alkali electrolytic processes a brine solution (electrolyte) is electrolyzed by passing electric current therethrough in a cell having a diaphragm separator means or a membrane separator means positioned between the cathode means and the anode means. Chlorine is produced at the anode means while sodium hydroxide (NaOH) and hydrogen (H) are formed at the cathode means. Brine is fed continuously to the cells, while Cl, NaOH and H are continuously withdrawn from the cells.

The minimum voltage required to electrolyze an electrolyte into Cl, NaOH and H may be calculated using the thermodynamic data. However, in commercial practice, the theoretical amount of voltage is not achievable and higher voltages must be used to overcome the various resistances inherent in the various types of cells. To increase the efficiency of the operation of a diaphragm or a membrane cell one may attempt to reduce the overvoltages of the electrodes, to reduce the electrical resistance of the diaphragm or membrane, or reduce the electrical resistance of the brine being electrolyzed. The invention herein described results in an electrode particularly useful as a cathode in the electrolysis of brine; cathode overvoltage is substantially reduced, resulting in increased power efficiencies.

Because of the multi-million-ton quantity of alkali metal halides and water electrolyzed each year, even a reduction of as little as 0.05 volts in working voltage translates to very meaningful energy savings. Consequently, the industry has sought means to reduce the voltage requirement.

Throughout the development of chlor-alkali technology, various methods have been developed to reduce the cell voltage. Some practitioners have concentrated on reducing cell voltage by modifying the physical design of the electrolytic cell, while others have concentrated their efforts on reducing the over-voltage at the anode or the cathode. The present disclosure pertains, in part, to a novel process to make an electrode that is characterized by a significantly low overvoltage and to the use of these electrodes in electrolytic cells.

It has been disclosed that an electrode's overvoltage is a function of the current density and its composition (reference: *PHYSICAL CHEMISTRY,* 3rd ed., W. J. Moore, Prentice Hall (1962), pp. 406–408), where the current density refers to the amperage applied per unit of true surface area of an electrode and composition refers to the chemical and physical makeup of the electrode. Therefore, a process that will increase an electrode's surface area should decrease its overvoltage at a given apparent current density. It is also desirable to use a composition of matter that is a good electrocatalyst; this further reduces the overvoltage.

It is well known in the art to use plasma or flame spraying to coat an electrode with an electroconductive metal. In U.S. Pat. No. 1,263,959 it was taught that anodes may be coated by spraying fine nickel particles onto an anode, wherein the particles are rendered molten and impacted on the iron substrate by means of a blast.

Cathodes, also, have been coated with electroconductive metals. In U.S. Pat. No. 3,992,278, cathodes were coated by plasma spraying or flame spraying an admixture of particulate cobalt and particulate zirconia. When these electrodes are used for the electrolysis of water or an aqueous alkali metal halide salt solution, they are said to give prolonged lowering of hydrogen overvoltage.

Various metals and combinations of metals have been used to coat electrodes by plasma or flame spraying: U.S. Pat. No. 3,630,770 teaches the use of lanthanum boride; U.S. Pat. No. 3,649,355 teaches the use of tungsten or tungsten alloy; U.S. Pat. No. 3,788,968 teaches the use of titanium carbide or titanium nitride and at least one metal and/or metal oxide of the platinum group and a second oxide coating which is porous: U.S. Pat. No. 3,945,907 teaches the use of rhenium: and U.S. Pat. No. 3,974,058 teaches the use of cobalt as a coating with an overcoat of ruthenium.

It is, likewise, well known in the art to make porous electrode coatings by selective leaching. Coating an electrode with particulate nickel, then sintering the nickel as taught in U.S. Pat. Nos. 2,928,783 and 2,969,315; electrodepositing an alloy onto a substrate then leaching out one component of the alloy as taught in U.S. Pat. No. 3,272,788: pressing or cementing two or more components together or onto an electrode substrate and then selectively leaching out one or more of the coating components as illustrated by U.S. Pat. Nos. 3,316,159; 3,326,725; 3,427,204: 3,713,891 and 3,802,878.

It is also disclosed in the art to combine the steps of making electrodes by plasma- or flame-spraying followed by leaching. It is also disclosed to combine the steps of electroplating followed by leaching. Examples of known methods are illustrated in the following patents; U.S. Pat. No. 3,219,730 teaches coating a substrate with a multiple oxide film coating then removing the substrate by leaching, thus forming an electrode: U.S. Pat. No. 3,403,057 teaches flame or plasma spraying a Raney alloy onto a substrate followed by leaching aluminum out of the alloy thus leaving a porous electrode; U.S. Pat. No. 3,492,720 teaches plasma spraying tungsten, titanium or alloys thereof along with aluminum, thorium and zirconium oxides onto a substrate. The substrate was subsequently removed, leaving a porous electrode. U.S. Pat. No. 3,497,425 teaches preparing porous electrodes by coating the substrate with a relatively insoluble metal followed by a coating of a more easily dissolvable metal. The teaching requires heat treating to cause inter-diffusion of the two coats, while optimum conditions require separate heat treatments for each coat. The dissolvable metal is subsequently leached out, leaving a porous electrode. U.S. Pat. No. 3,618,136 teaches forming porous electrodes by coating a binary salt composition onto a substrate and leaching a soluble component from the system. The patent teaches that it is critical that the binary salt mixture is a eutectic composition and that optimum results are obtained when the same anions are used for both the active and the inactive salts e.g. silver chloride—sodium chloride.

Netherlands patent application No. 75-07550 teaches the preparation of porous cathodes by applying to a substrate a coating of at least one non-noble metal from the group of nickel, cobalt, chromium, manganese and iron, alloyed with a secondary, less noble, sacrificial metal followed by removal of at least a part of this sacrificial metal. Specifically, the sacrificial metal is chosen from the group of zinc, aluminum, magnesium and tin. The sacrificial metal is removed by leaching with a lye solution or an acid solution.

Japanese Pat. No. 31-6611 teaches forming a porous electrode by electroplating onto a substrate a nickel coating followed by a coating of zinc or some other soluble substance which is soluble in an alkaline solution. These coated electrodes are then either immersed in an alkaline solution or subjected to an electrochemical anodizing treatment to elute and remove zinc and other soluble substances, thus forming a porous electrode. Prior to immersion, a heat treatment of the coated electrode is required in some embodiments.

U.S. Pat. No. 4,279,709 discloses a method for making electrodes including electrodes having reduced overvoltage by applying an admixture of particulate metal and a particulate inorganic compound pore former and then leaching out the pore-former to form pores.

Electrodes of film-forming metal substrates, especially titanium, coated with oxides of Group VIII metals of the Periodic Table of The Elements have been taught, especially conjointly with other metal oxides as being useful as anodes in electrolytic processes, such as in brine electrolysis. Ruthenium oxides, platinum oxides, and other oxides of the "platinum metal series", in association with various other metal oxides have received much acclaim as coatings for valve metal substrates (esp. Ti) for use as anodes. Patents relating to such anodes are, e.g. U.S. Pat. Nos. 3,632,498 and 3,711,385. These coatings may be applied in several ways, for example, U.S. Pat. No. 3,869,312 teaches that platinum group metal oxides, combined with film-forming metal oxides may be deposited on valve metal substrates by applying a mixture of thermally decomposable compounds of platinum group metals and a thermally-decomposable organo-compound of a film-forming metal in an organic liquid vehicle which may also optionally contain a reducing agent, to a support member, drying the coating by evaporation of the organic vehicle, then heating the member in the range of 400°-550° C. to form metal oxides. Repeated coats are applied to increase the thickness of the coating. Also an overcoating of a film-forming metal oxide is applied. U.S. Pat. No. 3,632,498 teaches that coatings of finely divided oxides of platinum group metals and film-forming metals may be produced by use of a plasma burner, by heating substrates which have been coated with thermally-decomposable compounds of platinum group metals and film-forming metals, by electrically depositing the metals in a galvanic bath followed by heating in air to form the oxide, among others.

Some further patents relating to electrodes having metal oxide surfaces are, e.g., U.S. Pat. Nos. 3,616,445; 4,003,817; 4,072,585; 3,977,958; 4,061,549; 4,073,873; and 4,142,005.

The use of platinum group metal oxides, particularly ruthenium oxide, in active coatings for the evolution of hydrogen is also known (ref. Melendres, Carlos A., SPRING MEETING ELECTROCHEM. SOC., May 11-16, 1975). Japanese patent publication no. 9130/65, application (OPI) nos. 131474/76 and 11178/77 refer to the use of a mixture of platinum group metal oxide(s) with another metal oxide as active cathode coatings. U.S. Pat. No. 4,238,311 teaches that a cathode coating consisting of fine particles of platinum group metals and/or platinum group metal oxides in nickel is useful as a cathode coating.

In general, it is known by those skilled in the art that the use of oxides of platinum group metals as active catalysts for the evolution of hydrogen in modern electrolytic chlor-alkali cells employing permionic membranes is not useful because of extreme conditions of NaOH concentration and temperature now possible, wherein NaOH concentrations of 30% and temperatures exceeding 95° C. are not uncommon. Oxide coatings prepared according to the known art are found to decrepitate with use and fail by loss of adherence to the substrate, accompanied presumably by substantial reduction, in some cases, to base metals.

It is also well known to those practiced in the art that catalytic coatings consisting of metals with intrinsically low hydrogen overvoltage properties are subject in actual practice to loss of catalytic activity due to overplating with metallic contaminants, such as iron for example, which are commonly present in brine and water employed in the process of electrolysis. Consequently, active coatings found useful by those practiced in the art for evolution of hydrogen in modern electrolytic membrane chlor-alkali cells are limited to the type characterized by high surface area, or porous coatings, with compositions resistant to some degree to chemical attack at these conditions, e.g. nickel or various stainless steels.

In these cases, the full effect of the catalytic nature of intrinsically low hydrogen overvoltage catalysts are not realized in practice, since, as is well known to those practiced in the art, the performance of these essentially high surface area coatings degrades in time to a level characterized by the equivalent coating of the predominant metallic contaminant present in the brine or water employed in the electrolytic process, usually Fe. Consequently, the Tafel slope characterizing the electrolytic activity of the applied coating changes to essentially that of iron, with a resulting increase in hydrogen overvoltage, especially at higher current densities, i.e. 1.5 to 3.5 amps per square inch and above, as are common in modern membrane chlor-alkali cells. In contrast, it is desirable to maintain the intrinsically low overvoltage properties of those materials which are known to be characterized by low Tafel slopes, i.e. platinum group metal oxides, particularly ruthenium oxide, during long-term operation in membrane chloralkali cells. It has now been discovered, among other things, that active coatings of oxides of platinum group metals and secondary electrocatalytic metals may be prepared which, when prepared according to the process of the invention, exhibit unexpected properties of low hydrogen overvoltage, physical stability, and long-term efficacyas cathodes in the electrolysis of brine at conditions of high NaOH concentrations, temperatures, and process pressures. It has also been discovered that the use of these electrodes in electrolytic processes wherein chlorine and caustic soda are produced at certain process conditions of temperature, NaOH concentration, pressure, etc., results in reduced energy requirements not otherwise attainable in practice.

"M & E" stands for Membrane and Electrode. A M & E is a structure composed of an ion exchange membrane having a plurality of electrically conductive, electrooatalytic oxides present on one, or both, surfaces of an ion exchange membrane. The electrically conductive, electrocatalytic oxides serve as a particulate electrode when the M & E is used in an electrochemical cell. M & E structures are sometimes called solid polymer electrolyte structures or SPE structures.

"M & E cells" are electrochemical cells employing an M & E structure. Such cells can be operated as an electrolytic cell for the production of electrochemical products, or they may be operated as fuel cells for the production of electrical energy. Electrolytic cells may, for example, be used for the electrolysis of an alkali metal halide such as sodium chloride or for the electrolysis of water.

M & E cells are rather well known in the art and are discussed in detail in the following U.S. Pat. Nos.: 4,293,394; 4,299,674; 4,299,675; 4,319,969; 4,345,986; 4,386,987; 4,416,932; 4,457,822; 4,469,579; 4,498,942; 4,315,805; 4,364,815; 4,272,353; and 4,394,229.

It would be highly desirable to prepare M&E cells having electrodes which are electrocatalytic oxide particles formed from metal salts which have been converted to metal oxides. However, the membranes upon which such metal oxides are desired to be placed will decompose if heated to temperatures sufficient to convert metal salts to metal oxides.

SUMMARY OF THE INVENTION

The invention is a method for preparing electrocatalytic oxides and applying them to substrates that cannot be heated to temperatures sufficiently high to convert electrocatalytic salts into electrocatalytic oxide comprising:

(a) dissolving Ru salt(s) and Ni salt(s) in a solvent to form an electrocatalytic salt solution;

(b) evaporating the solvent from the electrocatalytic salt solution, leaving a electrocatalytic salt residue;

(c) heating the electrocatalytic salt residue in the presence of oxygen to a temperature and for a time sufficient to convert substantially all of the the electrocatalytic salt into a electrocatalytic oxide; and (d) bonding the so-formed electrocatalytic oxide to a substrate that would be detrimentally affected if it were to be heated to 480°-500° C.

DETAILED DESCRIPTION OF THE INVENTION

The electrocatalytic salt coatings of the present invention preferably use Ru and Ni salts which are converted from their salt form into their oxide form and used on substrates as catalytically active coatings. Ruthenium and nickel oxides have been found to make surprisingly good electrocatalytic oxide coatings when they are applied to the surface of a membrane. Salts of Ru and Ni which are suitable for use in the present invention include halide, sulphate, nitrate or other soluble salts or soluble compounds. Preferable, however, they are in their halide forms. Most preferably, they are chlorides.

Preferably, Ru and Ni are present in a weight ratio of from about 0.5 to about 10 parts Ru per 1 part Ni. More preferably, the weight ratio of Ru:Ni is from about 1 to about 2.5 parts Ru per part Ni. Most preferably, the ratio of Ru:Ni is from about 1.6 parts Ru per part Ni.

The solvent for the Ru and Ni salts can include any solvent for both the salts. Common solvents can include water and organic alcohols. Preferably, the solvent is water because water is less flammable, and thus safer, than alcohol. When the solution is water, the water is used a a level of about 75 grams water per gram of Ru/Ni. When the solvent is an alcohol, the alcohol is generally used at a level of about 50 grams alcohol per gram of Ru/Ni. However, wide variations in the amount of solvent are tolerable and the amount of Ru/Ni in the solvent is not critical to the successful operation of the invention.

In addition to the solvent, additional components can be added to the solution such as hydrochloric acid. These materials are added because the salts are generally more soluble in acid solutions.

Substrates suitable for use in the present invention includes substrates which cannot be heated to temperatures as high as those required for the conversion of the electrocatalytic salts into electrocatalytic oxides. Such substrates include fluoropolymer membranes and fluoropolymer scrims. When fluoropolymer scrims are used, the electrocatalytic oxide is coated onto the scrim, which is bonded to a membrane. For use as membrane/electrode combinations (M&E's fluoropolymer membranes are used.

The M & E structure which can be formed from the electrocatalytic oxide coatings of the present invention includes embodiments where electrocatalytic oxides (formed from Ru and Ni salts) are bonded to or embedded in one, or both, sides of the membrane. In the M&E's of the present invention, at least one of the electrodes is in the form of a plurality of electrocatalytic oxides contacting the membrane. The electrocatalytic oxide particles can serve, during cell operation, as either a cathode or an anode. Optionally, both electrodes can be electrocatalytic oxides embedded into opposite sides of the membrane. For the purposes of the present discussion, the forms of both electrodes will be described as though they are electrocatalytic oxides and will also be described as if they are separate, conventional electrodes.

Conventional anodes are usually hydraulically permeable, electrically conductive structures made in a variety of shapes and styles including, for example, a screen of expanded metal, perforated plate, punched plate, unflattened diamond shaped expanded metal, or woven metallic wire. Metals suitable for use as anodes include tantalum, tungsten, columbium, zirconium, molybdenum, and preferably, titanium and alloys containing major amounts of these metals.

Conventional cathodes are usually hydraulically permeable, electrically conductive structures made in a variety of shapes and styles including, for example, a screen of expanded metal, perforated plate, punched plate, unflattened diamond shaped expanded metal, or woven metallic wire. Metals suitable for use as cathode include, for example, copper, iron, nickel, lead, molybdenum, cobalt, alloys including major amounts of these metals, such as low carbon stainless steel, and metals or alloys coated with substances such as silver, gold, platinum, ruthenium, palladium, and rhodium.

Membranes that are suitable for use in the present invention may be constructed of a fluorocarbon-type material or of a hydrocarbon-type material. Such membrane materials are well known in the art. Preferably, however, fluorocarbon materials are generally preferred because of their chemical stability.

Nonionic (thermoplastic) forms of perfluorinated polymers described in the following patents are particularly suitable for use in the present invention because they are easily softened by heating and make it easy to bond the membrane to the electrocatalytic oxide particles and to the flat screen template. Membranes which are suitable are described in the following U.S. Pat. Nos.: 3.282,875; 3,909,378; 4,025,405; 4,065,366; 4,116,888; 4,123,336; 4,126,588; 4,151,052; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; 4,358,545; 4,417,969; 4,462,877; 4,470,889; and 4,478,695; European Patent Application No. 0,027,009. Such polymers usually have equivalent weight in the range of from about 500 to about 2000. The membranes can be a single layer or they can be a multilayer membrane. Some of the more useful membranes are bilayer membranes having sulfonic ion exchange groups in one layer and carboxylic ion exchange groups in the other layer.

To allow the substantially flat, screen template and the electrocatalytic oxides to be embedded into the fluorocarbon membrane, it is desirable for the fluorocarbon membrane to be in its thermoplastic form. It is in a thermoplastic form when it is made and before it is converted into an ion exchange form. By thermoplastic form, it is meant, for instance, that the membrane has $SO_2X$ pendant groups, where X is —F, —$CO_2$, —$CH_3$, or a quaternary amine, rather than ionically bonded $SO_3Na$ or $SO_3H$ pendant groups.

Particularly preferred fluorocarbon materials for use in forming membranes are copolymers of monomer I with monomer II (as defined below). Optionally, a third type of monomer may be copolymerized with I and II.

The first type of monomer is represented by the general formula:

$$CF_2=CZZ' \quad (I)$$

where: Z and Z' are independently selected from the group consisting of —H, —Cl, —F, or —$CF_3$.

The second type of monomer consists of one or more monomers selected from compounds represented by the general formula:

$$Y-(CF_2)_a-(CFR_f)_b-(CFR_{f'})_c-O-[CF(CF_2X')-CF_2-O]_n-CF=CF_2 \quad (I)$$

where:

Y is selected from the group consisting of $SO_2Z$, —CN, —COZ, and $C(R_{3f})(R_{4f})OH$;

Z is —I, —Br, —Cl, —F, —OR, or —$NR_1R_2$;

R is a branched or linear alkyl radical having from 1 to about 10 carbon atoms or an aryl radical:

$R_{3f}$ and $R_{4f}$ are independently selected from the group consisting of perfluoroalkyl radicals having from 1 to about 10 carbon atoms;

$R_1$ and $R_2$ are independently selected from the group consisting of —H, a branched or linear alkyl radical having from 1 to about 10 carbon atoms or an aryl radical;

a is 0–6;

b is 0–6;

c is 0 or 1;

provided a+b+c is not equal to 0;

X is —Cl, —Br, —F, or mixtures thereof when n>1;

n is 0 to 6; and $R_f$ and $Rf_f'$ are independently selected from the group consisting of —F, —Cl, perfluoroalkyl radicals having from 1 to about 10 carbon atoms and fluorochloroalkyl radicals having from 1 to about 10 carbon atoms.

Particularly preferred is when Y is —$SO_2F$ or —$COOCH_3$;

n is 0 or 1;

$R_f$ and $R_f'$ are —F:

X is —Cl or —F:

and a+b+c is 2 or 3.

The third, and optional, monomer suitable is one or more monomers selected from the compounds represented by the general formula:

$$Y'-(CF_2)_{a'}-(CFR_f)_{b'}-(CFR_{f'})_{c'}-O-[CF(CF_2X')-CF_2-O]_{n'}-CF=CF_2 \quad (III)$$

where:

Y' is —F, —Cl or —Br;

a' and b' are independently 0–3;

c is 0 or 1;

provided a'+b'+c' is not equal to 0;

n', 0–6;

$R_f$ and $R_{f'}$ are independently selected from the group consisting of —Br, —Cl, —F, perfluoroalkyl radicals having from about 1 to about 10 carbon atoms, and chloroperfluoroalkyl radicals having from 1 to about 10 carbon atoms; and X' is —F, —Cl, —Br, or mixtures thereof when n'>1.

Conversion of Y to ion exchange groups is well known in the art and consists of reaction with an alkaline solution. The membrane may be converted to its ionic form by reacting it with, in the case of —$SO_2F$ pendant groups, 25 weight % NaOH under the following conditions: (1.) immerse the film in about 25 weight percent sodium hydroxide for about 16 hours at a temperature of about 90° C.; (2.) rinse the film twice in deionized water heated to about 90° C., using about 30 to about 60 minutes per rinse. The pendant group is then in the —$SO_3$—$Na^+$ form. Cations other than —$Na^+$ can be made to replace the $Na^+$ if practical (such as —$H^+$).

The electrocatalytic oxides, whether used as an anode or as a cathode are preferably finely divided and have a high surface area. For example, in the case of an oxygen or hydrogen electrode fuel cell, platinum black (surface area greater than 25 $m^2$/gram) or high surface area (800–1800 $m^2$/g) platinum on activated carbon powder (average particle size 10–30 microns) are quite suitable for use as the anode and the cathode. In the case of a chlorine cell, an electrode may be prepared in which ruthenium dioxide particles are prepared by thermal decomposition of ruthenium nitrate for 2 hours at 450° C. The resulting oxide may then be ground using a mortar and pestle and the portion which passed through a 325 mesh sieve (less than 44 microns) used to prepare an electrode.

In general, the preferred method contemplated in forming the electrocatalytic particles of the present invention comprises first forming an aqueous solution containing a nickel salt and a ruthenium salt. The solution is heated to evaporate the solvent, leaving the dissolved metal values. Evaporation temperatures of from about 25° to about 100° C. are commonly used. Then the material is heated to a temperature sufficient to concentrate the metal values, also substantially driving out the the anions or negative-valence radicals released from the metal salts as they decompose because of the temperature. Thereafter, the material is heated in the presence of oxygen or air to a temperature sufficient to thermally oxidize and convert the electrocatalytic salts to electrocatalytic oxides. Although heating times can vary depending upon the salts and the temperatures, heating times from about 5 minutes to about 120 minutes are generally sufficient.

Ordinarily the temperatures at which thermal oxidation of the metals is achieved is somewhat dependent on the metals, but a temperature in the range of about 300° C. to about 650° C., more or less, is generally effective. It is generally preferred that the thermal oxidation be performed at a temperature in the range of about 350 degrees to 550° C.

There are a number of suitable ways for depositing the electrocatalytic oxide particles onto the membrane. Such methods are well known in the art and are outlined, for example, in the following U.S. Pat. Nos. 4,293,394; 4,299,674; 4,299,675; 4,319,969; 4,345,986; 4,386,987; 4,416,932; 4,457,822; 4,469,579; 4,498,942; 4,315,805; 4,364,815; 4,272,353; and 4,394,229. The teachings of these patents are incorporated by reference for the purpose of their teachings on how to deposit particles onto membranes to form M&E's. Some particularly suitable ways for Ser. No. 944396 filed Dec. 19, 1986; 944275 filed Dec. 19, 1986; 944277 filed Dec. 19, 1986; 944278 filed Dec. 19, 1986; 944279 filed Dec. 19, 1986; 944475 filed Dec. 19, 1986; 944395 filed Dec. 19, 1986; and 944478 filed Dec. 19, 1986.

An example of a method to form M&E's involves forming a slurry of the electrocatalytic oxide particles and paint or spray the slurry through the openings in a screen template onto the membrane. Spraying the solution/dispersion onto the membrane through the flat screen template may also be used to advantage for covering large or irregular shapes. Pouring the solution/-dispersion onto the membrane through the screen template may also be used. Painting the solution/dispersion with brush or roller has been successfully employed. In addition, coatings may be easily applied with metering bars, knives, or rods. Usually, the coatings or films are built up to the thickness desired by repetitive application. A variety of printing techniques can also be used to apply the solution/dispersion to the membrane.

A particularly suitable method for depositing the catalytic particles onto the screen template involves forming a coupon of the electrocatalytic oxide particles on a removable substrate by first forming a solution/dispersion of the electrocatalytic oxide particles in a solvent/dispersant. Preferably, the solvent/dispersant used for suspending the catalytic particles is one which will at least partially dissolve the polymer making up the ion exchange membrane. This tends to give better bonding of the particles to the membrane.

Once the particles have been placed on the membrane, it is then desirable to more permanently fix the electrocatalytic oxide particles to the membrane. This may be accomplished by subjecting the coated membrane to additional pressure and heat. The coated membrane (in a thermoplastic form or in a sodium form) may, for example, be heated to temperatures as high as about 260° C. for a time period of from about 30 seconds to about 1 minute to cause the components to bond together. When the membrane is in its hydrogen form, it should preferably not be heated to temperatures above about 180° C. because it will tend to decompose. These temperatures soften the binder in the electrocatalytic oxides particle solution/dispersion and soften the membrane, allowing the two to bond to each other. Too low a temperature or too short a time of heating results in the electrocatalytic oxide particles not being completely bonded to the membrane. Too long a time results in too much blending of the particles with the membrane. Too high a temperature causes the membrane to melt which prevents the proper M & E from being formed.

It is sometimes beneficial to heat the combination under pressures of up to about 3.5 kilograms per square centimeter to ensure good bonding of the components. However, pressures greater than about 3.5 kilograms per square centimeter tend to flatten the combination too much.

Preferably, a heated press is used to bond the components. Although a variety of procedures may be suitably used, one that has been found to be particularly useful involves forming a sandwich of the components between two platens, an upper platen and a lower platen. On top of the lower platen is a screen of polytetrafluoroethylene paper, the membrane having the electrocatalytic oxide particles coated thereon, another screen of polytetrafluoroethylene paper, a rubber screen to provide resilience, another screen of polytetrafluoroethylene paper, and finally, the upper platen. This sandwich is then placed in a heated press and heated under pressure to effect the bonding.

The methods and techniques for using the membranes of the present invention having electrocatalytic oxide particles bonded to at least one face of the membrane is well known in the art. Generally, however, a current collector is pressed against the islands of electrocatalytic oxide particles and is connected with a power supply (in the case of an electrolytic cell) or with a power consuming device (in the case of fuel cells or batteries). The current collector conducts electrical energy to (or from) the electrocatalytic oxide particles. Optionally, one may use a resilient device, such as a mattress, to hold the current collector against the coated membrane.

The M & E structure of the present invention is useful in a wide variety of electrochemical cells including, for example, fuel cells for the continuous production of electrical energy; electrolysis cells for the production of chemical products (such as chlorine and caustic from a sodium chloride brine solution or hydrogen and oxygen from water); and batteries for the intermittent production of electrical energy.

EXAMPLE

A solution of electrocatalytic salts is prepared by mixing 3 grams of $RuCl_3.3H_2O$, 3 grams $NiCl_2.6H_2O$, 10 milliliters of 37% HCl, and 210 milliliters of isopropanol. The mixture is blended until the salts dissolve.

About 1 liter of the solution is placed in a pyrex dish and placed on a heating element. The solution is slowly heated while being stirred to allow the solution to evaporate. After all the isopropanol is evaporated the pyrex dish is placed in an oven and baked at a temperature of between about 480° C. and 500° C. for about two hours. This converts the Ru and Ni salts into electrocatalytic oxides.

The electrocatalytic oxides were removed from the pyrex dish and were ground with a mortar and pestil to a fine powder.

A mixture of about 92 grams of the electrocatalytic oxide particles and about 8 grams of carboxylic ion exchange fluoropolymer particles are dissolved and suspended in $BrCF_2$-$CF_2Br$ in a ball mill. First the components are weighed and blended with each other dry. Then sufficient $BrCF_2$-$CF_2Br$ is added to cover the dry ingredients. The mixture is then blended in a ball mill for a time period of about 24 hours to obtain a uniform mixture. This also gives time for the ionomer to be broken up and at least partially dissolved. Then, the mixture is allowed to settle and the excess $BrCF_2$-$CF_2Br$ is decanted off. At this point, the mixture contains about 25 weight percent solids.

The mixture is applied to a sheet of aluminum foil by spraying with an airless spray gun to a thickness of about 20–30 microns. The mixture is allowed to air dry. The coated foil is then placed in an oven and heated to a temperature of from about 250° to about 260° C. for approximately 10 minutes to sinter the dispersion into a decal.

A bilayer fluoropolymer ion exchange membrane having a carboxylic layer approximately 0.5 mil (0.0millimeter) thick and having a sulfonic layer approximately 3.5 mils (0.9 millimeter) thick is placed on a sheet of polytetrafluoroethylene with the sulfonic layer contacting the polytetrafluoroethylene sheet.

An approximately 56 square centimeter sample of an electroformed screen template from Perforated Products, Inc., in Brookline, Massachusetts, a division of Veco International Corporation is placed onto the carboxylic layer of the membrane. The screen has a plurality of 0.029 inch (0.7 millimeters) in diameter evenly distributed across its face. There are a sufficient number of holes to make the screen approximately 50% open. The screen has a thickness of about 0.0028 inch (0.1 millimeters).

Then aluminum sheet having the sintered decal on it is placed onto the screen with the decal contacting the screen. Then a sheet of polytetrafluoroethylene is placed on top of the aluminum foil. The combination is placed in a heated, hydraulic press and pressed at about 50 pounds per square inch (3.5 kilograms per square centimeter) at a temperature of about 170° C. for from about 30 to about60 seconds. The pressure pushes portions of the coupon through the holes in the screen onto the membrane, forming a plurality of islands of catalytically active particles on the membrane. The heat and pressure cause the islands of catalytically active particles to bond to the membrane.

The combination is then removed from the press and the polytetrafluoroethylene sheets are removed. Then the screen is removed, leaving a membrane having a plurality of islands of catalytically active material on the membrane.

We claim:

1. A method for preparing electrocatalytic oxides and applying them to fluoropolymer substrates that cannot be heated to temperatures sufficiently high to convert electrocatalytic salts into electrocatalytic oxide comprising:

(a) dissolving SaHs of Ru and Ni in a solvent to form an electrocatalytic salt solution;

(b) evaporating the solvent from the electrocatalytic salt solution, leaving a electrocatalytic salt residue;

(c) heating the electrocatalytic salt residue in the presence of oxygen to a temperature and for a time sufficient to convert substantially all of the the electrocatalytic salt into a electrocatalytic oxide; and (d) bonding the so-formed electrocatalytic oxide to a fluoropolymer substrate that would be detrimentally affected if the substrate were to be heated to 480°–500° C.

2. The method of claim 1 wherein the electrocatalytic salts are selected from the group of halides, nitrates, sulphates, or phosphates.

3. The method of claim 2 wherein the electrocatalytic salts are halides.

4. The method of claim 3 wherein the electrocatalytic salts are chlorides.

5. The method of claim 1 wherein the solvent is an organic alcohol.

6. The method of claim 1 wherein the solvent is water.

7. The method of claim 1 wherein the solution includes an acid.

8. The method of claim 7 wherein the acid is hydrochloric acid.

9. The method of claim 1 wherein the ratio of Ru to Ni is from about 0.5 to about 10 parts Ru per part Ni.

10. The method of claim 9 wherein the ratio of Ru to Ni is from about 1 to about 2.5 parts Ru per part Ni.

11. The method of claim 9 wherein the ratio of Ru to Ni is from about 1.6 parts Ru per part Ni.

12. The method of claim 1 wherein the solvent is evaporated at a temperature of from about 25° to about 100° C.

13. The method of claim 1 wherein the electrooatalytic salt is heated to a temperature of from about 300° to about 600° C. to convert it into an electrocatalytic oxide.

14. The method of claim 13 wherein the heating of the electrocatalytic salt takes place for a period of time of about 5 to about 120 minutes.

15. The method of claim 1 wherein the fluorocarbon membrane is a copolymer of at least two types of monomers wherein the first type of monomer is represented by the general formula:

$$CF_2=CZZ' \quad (I)$$

where: Z and Z′ are independently selected from the group consisting of —H, —Cl, —F, or —$CF_3$.

and the second type of monomer is represented by the general formula:

$$Y-(CF_2)_a-(CFR_f)_b-(CFR_f')_c-O-[CF(CF_2X)-CF_2-O]_n-CF=CF_2 \quad (II)$$

where:

Y is selected from the group consisting of $-SO_2Z$, $-CN$, $-COZ$, and $C(R_{3f})(R_{4f})OH$;

Z is —I, —Br, —Cl, —F, —OR, or $-NR_1R_2$;

R is a branched or linear alkyl radical having from 1 to about 10 carbon atoms or an aryl radical;

$R_{3f}$ and $R_{4f}$ are independently selected from tne group consisting of perfluoroalkyl radicals having from 1 to about 10 carbon atoms;

$R_1$ and $R_2$ are independently selected from the group consisting of —H, a branched or linear alkyl radical having from 1 to about 10 carbon atoms or an aryl radical;

a is 0–6;

b is 0–6;

c is 0 or 1;

provided a+b+c is not equal to 0;

X is —Cl, —Br, —F, or mixtures thereof when $n>1$;

n is 0 to 6; and $R_f$ and $R_f'$ are independently selected from the group consisting of —F, —CI, perfluoroalkyl radicals having from 1 to about 10 carbon atoms and fluorochloroalkl radicals having from 1 to about 10 carbon atoms.

16. The method of claim 15 wherein

Y is $-SO_2F$ or $-COOCH_3$;

n is 0 or 1;

$R_f$ and $R_f'$ are —F;

X is —Cl or —F;

and a+b+c is 2 or 3.

17. The method of claim 15 wherein the fluorocarbon membrane includes a third monomer which is represented by the general formula:

$$Y'-(CF_2)_{a'}-(CFR_f)_{b'}-(CFR_f')_{c'}-O-[CF(CF_2X')-CF_2-O]_{n'}-CF-=CF_2 \quad (III)$$

where:

Y' is —F, —Cl or —Br;

a' and b' are independently 0–3;

c is 0 or 1;

provided a'+b'+c' is not equal to 0;

n' is 0–6; $R_f'$ and $R_f'$ are independently selected from the group consisting of —Br, —Cl, —F, perfluoroalkyl radicals having from about 1 to about 10 carbon atoms, and chloroperfluoroalkyl radicals having from 1 to about 10 carbon atoms; and X' is —F, —Cl, —Br, or mixtures thereof when $n'>1$.

* * * * *

UNITED STATES PATENT AND TRADEMARK OFFICE

CERTIFICATE OF CORRECTION

PATENT NO. : 4,871,703

DATED : October 3, 1989

INVENTOR(S) : Richard N. Beaver, Lloyd E. Alexander and Carl E. Byrd

It is certified that error appears in the above-identified patent and that said Letters Patent is hereby corrected as shown below:

Column 1, line 30; change the colon ":" between "mercury" and "the" to a semicolon --;--.

Column 3, line 50; insert a comma --,-- between "oxides" and "as".

Column 4, line 6; change the period "." after burner to a comma --,--.

Column 5, line 22; change "trooatalytic" to --trocatalytic--.

Column 6, line 45; insert a closed parenthesis --)-- following "(M&E'S".

Column 7, line 28; change the period "." between "3" and "2" to a comma --,-- to read "3,282,875;".

Column 7, line 67, general formula; change "(I)" to --(II)--.

Column 8, line 35, general formula; edit formula to read

-- $Y'-(CF_2)_{a'} - (CFR_f)_{b'} - (CFR_{f'})_{c'} - O - [CF(CF_2X') - CF_2 - O]_{n'} - CF - = CF_2$ --

UNITED STATES PATENT AND TRADEMARK OFFICE

CERTIFICATE OF CORRECTION

PATENT NO. : 4,871,703

DATED : October 3, 1989

INVENTOR(S) : Richard N. Beaver, Lloyd E. Alexander and Carl E. Byrd

It is certified that error appears in the above-identified patent and that said Letters Patent is hereby corrected as shown below:

Column 8, line 44; change "$R_f$" between "and" and "are" to --$R_f$'--.

Column 9, line 45; insert --forming M&E's are disclosed in U.S. Patent applications --between "for" and "Ser.".

Column 11, line 39; change "(0.0mil-)" to --(0.01 mil- --.

Column 11, line 61; insert a space between "about" and "60".

Column 12, line 10; change "SaHs" to --Salts--.

Column 12, line 39, Claim 9; insert --1-- between "per" and "part".

Column 13, line 10, Claim 15; change "tne" to --the--.

Column 14, line 1, Claim 15; change "fluorochloroalkl" to --fluorochloroalkyl--.

Signed and Sealed this

Twenty-first Day of January, 1992

*Attest:*

HARRY F. MANBECK, JR.

*Attesting Officer*

*Commissioner of Patents and Trademarks*